United States Patent [19]

Rumball

[11] 4,131,212

[45] Dec. 26, 1978

[54] CONTAINERS

[75] Inventor: Kenneth F. Rumball, Great Bookham, England

[73] Assignee: Airfix Industries Limited, London, England

[21] Appl. No.: 781,990

[22] Filed: Mar. 28, 1977

[51] Int. Cl.[2] ..... B65D 41/34

[52] U.S. Cl. ..... 215/252; 215/253; 215/255; 215/256

[58] Field of Search ..... 215/252, 253, 254, 255, 215/256

[56] References Cited

U.S. PATENT DOCUMENTS

| | | | |
|---|---|---|---|
| 3,650,428 | 3/1972 | Miller | 215/252 |
| 3,685,677 | 8/1972 | Westfall | 215/252 |
| 3,812,994 | 5/1974 | Feldman | 215/256 |
| 3,844,861 | 10/1974 | Irish | 215/254 |
| 3,850,329 | 11/1974 | Robinson | 215/254 |
| 3,874,540 | 4/1975 | Hidding | 215/252 |
| 3,901,404 | 8/1975 | Feldman | 215/256 |
| 3,980,195 | 9/1976 | Fillmore | 215/256 |

*Primary Examiner*—R. E. Hart

*Attorney, Agent, or Firm*—Scrivener, Parker, Scrivener & Clarke

[57] ABSTRACT

A container with a closure, the container and closure being engageable by relative rotation, locking means on the container and closure which allow the closure to be rotated in the direction required to apply the closure but not in the opposite sense, the locking means on one of the container and closure being formed as a tear band so as to unlock the pair of locking means and allow removal and replacement of the closure.

1 Claim, 4 Drawing Figures

CONTAINERS

This invention is concerned with improvements in and relating to containers and to lids for containers and more particularly to containers and to lids which engage lids and containers respectively by relative rotational movement.

It is a particular problem to provide a container to which a closure can be readily applied when the container is full, and particularly by means of conventional capping equipment, and which will be tamper-proof, that is to say to which access cannot be readily gained without causing a disturbance which remains apparent.

Various proposals have been made in which teeth, pawls or camming surfaces are provided on the container and on the lids, but in most cases the opening of the container requires rotation of the closure not only to overcome the resistance of the threaded engagement but additionally to break the points of attachment of the closure to an element which carries the teeth, pawls or camming surfaces locking the closure against unscrewing and removal. Further it is not always readily apparent that the points of attachment have been broken. In another proposal the toothed element is a separate entity from the closure and container.

According to the present invention there is provided a container having an opening and closure attachment means adjacent that opening and a closure including container attachment means engageable with the closure attachment means by relative rotation of the closure and container in one sense to secure the closure to the container in a position closing the opening, locking means on the container and on the closure which will allow such relative rotation in said one sense only, that portion of the container or closure carrying the associated locking means being a removable portion of the container or closure by tearing along a zone of weakness between it and the remainder of the container or closure to thereby disengage the locking means and release the closure for rotation relative to the container in the opposite sense to said one sense to remove the closure.

Preferably each locking means comprise teeth, though they may comprise recesses on the container or closure and teeth or pawls on the other, the closure attachment means and container attachment means comprise screw threads, though they may be the cooperating elements of a bayonet type connection, the closure attachment means and container attachment means and locking means are mouldings of thermoplastic materials, the zone of weakening is a region of reduced thickness and/or a perforated region and the removable portion includes a tab by which force may be applied in a suitable direction to initiate the tearing of the removable portion from the closure.

In order that the invention may be well understood there will now be described an embodiment thereof, given by way of example only, reference being had to the accompanying drawing in which.

Figure 1:
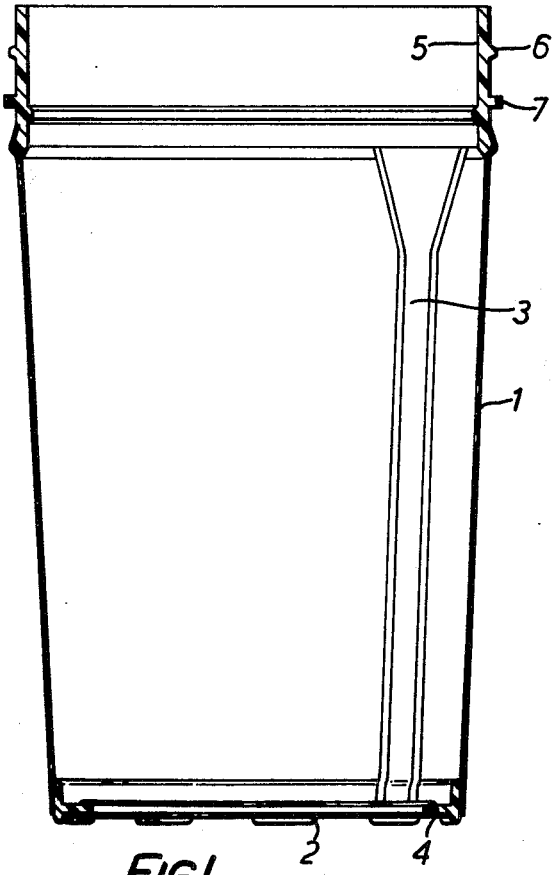
FIG. 1 is a sectioned elevation of a container.
Figure 3:
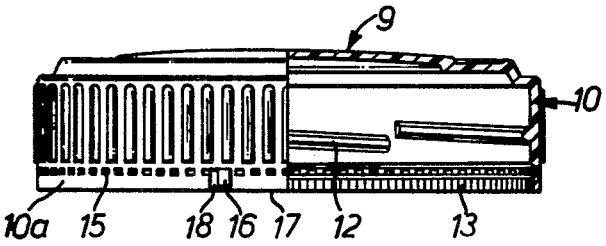
FIG. 3 is a partially sectioned elevation of a closure.
Figure 2:
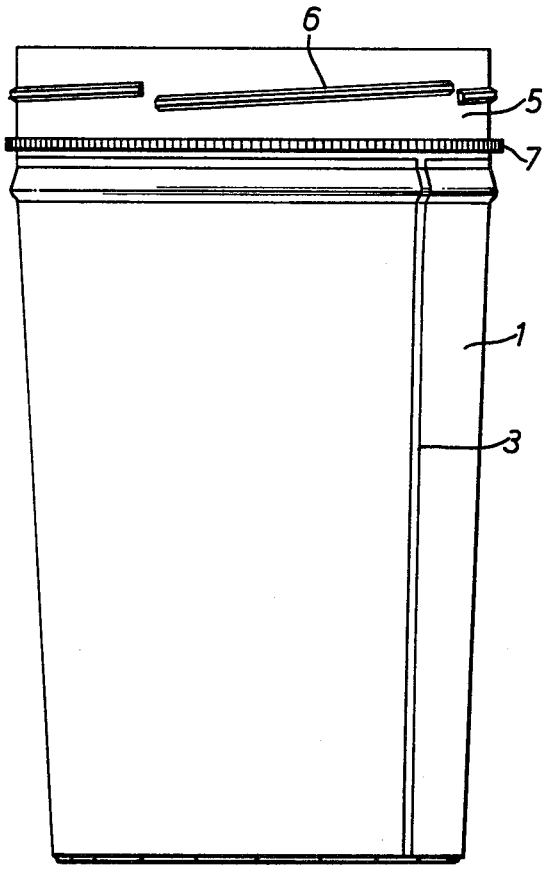
FIG. 2 is an elevation of the container.
Figure 4:
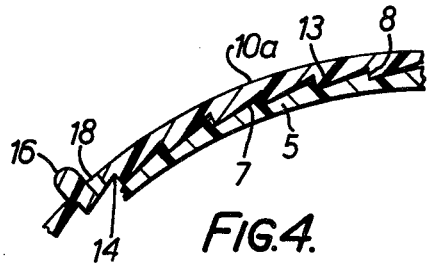
FIG. 4 is a scrap section of a container and closure applied to it in the mean plane of the locking teeth looking downwards.

The container illustrated is a composite container, that is a container made from a blank of flexible sheet material, such as paper, card or foil which when folded is seamed by injection moulding. A suitable blank is described and shown in our U.K. Pat. No. 1,348,370 and features of the container are described and shown in our U.S. Pat. applications Nos. U.S. 582898 and U.S. 581671. The container has a peripheral wall 1 and a base 2 which have been seamed at 3 and 4 for example as described in our copending application No. 786573. At the open end, the container is formed with a lip moulding 5 which includes a fourstart thread 6 and a plurality of locking teeth 7 which are of a progressively increasing radial thickness, in a clockwise direction as viewed looking toward the base of the container, up to a radial face 8.

A closure 9 is provided which is shown as an injection moulding having a skirt 10 but may comprise a central blank panel, as of card or the like, with a peripheral moulding forming the skirt. The moulding defines an internal fourstart thread 12 and a removable portion **10*a* carrying a plurality of internal teeth 13 each of which is of progressively increasing radial thickness in an anti-clockwise sense up to a radial end face 14. Between the region of the skirt 10 which defines the threads 12 and the removable portion 10*a*, the skirt has a weakened zone 15 here shown as of reduced thickness and with perforations though only one or the other may be used if desired. A projecting tab 16 is shown between the weakened zone 15 and the free edge 17 adjacent a tear-assist slot 18**, though the tab may be omitted.

A line of weakening 18 may be provided axially of the closure end adjacent one side of the root of tab 16.

When the container is full, the closure is applied by standard relative rotary motion between the closure and the container. As the closure reaches its axial position relative to the container as a result of that relative rotation and interengagement of the threads, the teeth 7 will be riding over the teeth 13 during such relative rotation. If now the sense of relative rotation is reversed the radial faces 14 of teeth 13 will be face to face with radial faces 8 of teeth 7 and these respective faces will abut and will not ride over one another. The closure and the container are thereby locked against relative rotation in a direction to allow the closure to be removed. However if tab 16 is pulled, removable portion **10*a* will rupture at the root of the axially extending weakening 18 whereupon further pull on the tab will rupture the circumferential weakening 15 and allow the portion 10*a* carrying teeth 13** to be removed. Such removal disengages the two sets of teeth and thereby allows the relative rotation of the closure and the container in both senses and hence removal and, if desired, reapplication of the closure.

While the closure has been described as encompassing the container, the reverse arrangement could be adopted with the circumferential weakening in the container moulding.

Furthermore, whilst the invention has been particularly described in relation to a composite container, it could be applied to other containers such as injection moulded containers.

It will be clear that, while there has been shown and described an arrangement where radial projections are provided on the lid and on the container, it is equally possible to form one set of projections as recesses.

I claim:

1. A container having an opening surrounded by a rim, screw threads on the exterior of the container adjacent to but below said rim, a closure member having a cover part engageable with the rim of the container and a depending annular skirt having a substantially uniform, straight, vertical outer surface extended between the cover part and the lower edge of said skirt, screw threads on the interior of said skirt engageable with the screw threads on said container, a plurality of radially outwardly extending ratchet teeth on said container below the screw threads thereof, a plurality of radially inwardly extending ratchet teeth on a portion of the skirt of the closure member adjacent the lower edge thereof, said ratchet teeth being arranged to engage and prevent unscrewing of said closure member when the latter has been screwed to a position wherein the cover part is seated on the rim of said container, a plurality of circumferentially spaced perforations around said closure member extending through said skirt between the threads thereof and the portion containing the teeth of said closure member, said perforations defining a tearable line of weakness, and tab means integral with said portion of said closure member skirt carrying said teeth for enabling said portion to be manually torn free of the skirt of the closure member along the line of said perforations after said closure member has been screwed into a closing position on said container, thereby enabling said closure member to be unscrewed in an opening direction.

* * * * *